United States Patent [19]

Patterson

[11] Patent Number: 5,050,688

[45] Date of Patent: Sep. 24, 1991

[54] ROCK DRILL FEED SUPPORT

[76] Inventor: William N. Patterson, 2796 Foxtail Way, Montrose, Colo. 81401

[21] Appl. No.: 440,018

[22] Filed: Nov. 21, 1989

[51] Int. Cl.[5] ..... E21C 5/06

[52] U.S. Cl. ..... 173/147; 173/160

[58] Field of Search ..... 173/31, 37, 39, 44, 173/147, 152, 154, 160

[56] References Cited

U.S. PATENT DOCUMENTS

| | | | |
|---|---|---|---|
| 2,365,749 | 12/1944 | Curtis . | |
| 2,394,194 | 2/1946 | McCarthy . | |
| 3,107,738 | 10/1963 | Osborn . | |
| 3,205,951 | 9/1964 | Pyles | 173/160 |
| 3,500,941 | 3/1970 | Rudman | 173/160 |
| 3,508,619 | 4/1970 | Huffman . | |
| 3,692,124 | 9/1972 | Kimber et al. | 173/160 |
| 3,917,005 | 11/1975 | Cannon et al. | 173/147 |
| 4,069,877 | 1/1978 | Durand | 173/160 |
| 4,207,805 | 6/1980 | Jonsson | 173/147 |
| 4,478,291 | 10/1984 | Futros | 173/147 |

*Primary Examiner*—Douglas D. Watts
*Assistant Examiner*—Scott A. Smith
*Attorney, Agent, or Firm*—Michael E. Martin

[57] ABSTRACT

A rock drill feed support beam comprises longitudinal side plates and a base member which are formed of folded metal plate welded together to form a channel-like support beam with a substantially clear unobstructed space between the members for containing a plurality of pressure fluid hoses which are trained over a hose guide supported by the feed beam and also disposed generally between the side members in the space. A feed mechanism comprising an endless chain is disposed in the channel-like space and includes a support member connected to the hose guide and supporting spaced apart sprockets. One run of the chain is connected to the drill motor and the opposite run of the chain is anchored to the feed beam. A motor is drivably connected to the chain through one of the sprockets for advancing the drill motor at twice the rate of the hose guide and the feed support member.

13 Claims, 2 Drawing Sheets

FIG. 1
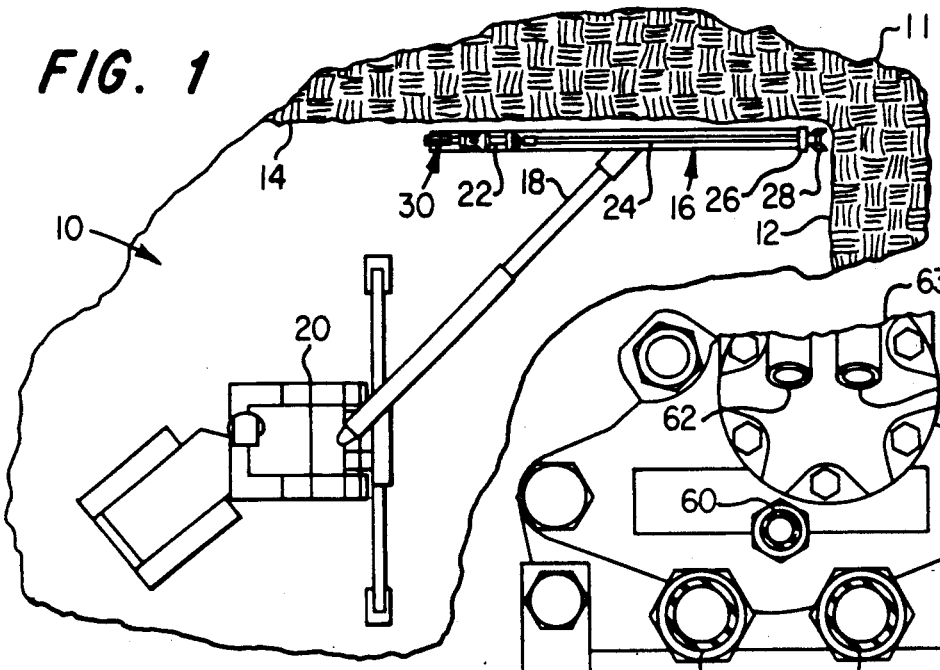
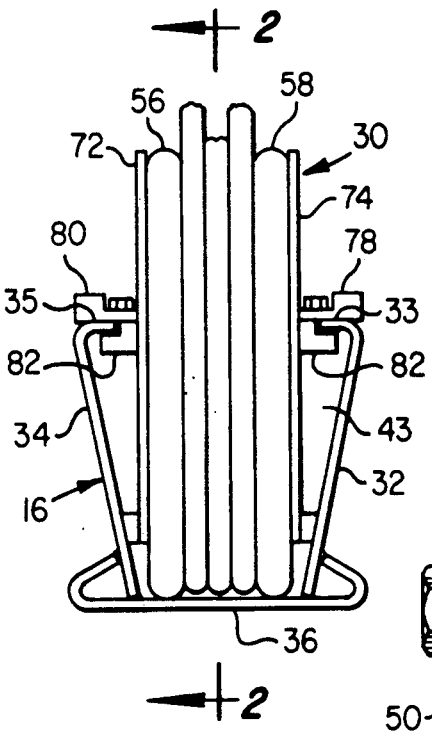
FIG. 4
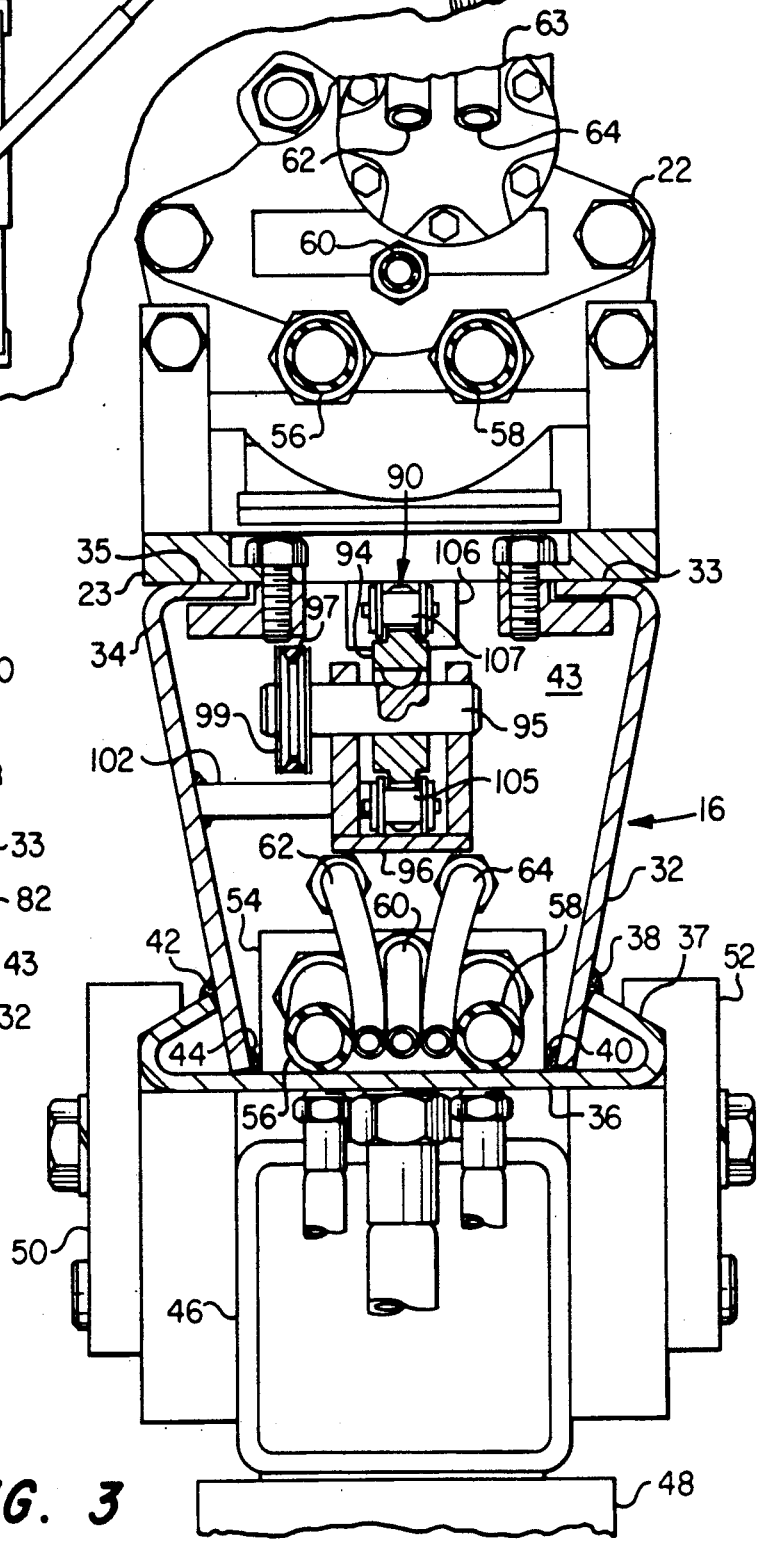
FIG. 3

ROCK DRILL FEED SUPPORT

BACKGROUND OF THE INVENTION

1. Field of the Invention

The present invention pertains to a feed support and advance mechanism for a pressure fluid operated rock drill.

2. Background

In the art of rock drills and associated feed supports a longstanding problem has been the proper routing and orientation of the pressure fluid hoses which lead from the source of pressure fluid to the rock drill. In particular, with rock drills which operate with hydraulic fluid for driving the impact as well as the rotation mechanisms, a relatively large number of relatively stiff pressure fluid hoses must be routed between the rock drill and a connection manifold for the hoses. Typically, the hoses are trained over a reel or support mechanism disposed at one end of the feed support and which advances with the drill along the feed support during operation. However, conventional feed supports require that the hoses be trained around a generally horizontal reel or hose support structure which increases the lateral clearance required of the drill feed support and reduces the range of drill position coverage. This latter problem is particularly acute in tunneling operations where it is often desired to position the feed support closely adjacent to a side wall of the tunnel when drilling into the tunnel face wall.

Another longstanding problem in the art of rock drill feed supports and feed mechanisms has been regarding the provision of a support which is significantly rigid, has a clear channel-like space on the structure to accommodate feed mechanisms and the aforementioned fluid hoses and to provide a feed mechanism which is capable of providing proper advance of the drill and in relation to a hose support reel or similar structure. Accordingly, the present invention has been directed to solving the aforementioned problems as well as providing other advantages in pressure fluid operated rock drills and associated feed supports and feed mechanisms.

SUMMARY OF THE INVENTION

The present invention provides an improved feed support and feed mechanism for a pressure fluid operated rock drill.

In accordance with one important aspect of the present invention there is provided a unique feed support or feed beam which is constructed in such a way as to provide a substantially open channel-like structure which is adapted to a relatively lightweight yet have significant rigidity for supporting a rock drill for linear advance and retraction and for accommodating pressure fluid hoses within substantially the envelope of the feed beam and thereby minimizing lateral clearance required for positioning the feed beam to drill against tunnel faces and the like. The support beam is of unique construction which comprises three elongated formed metal plate members which are suitably joined together, such as by welding, are substantially rigid and yet provide a large channel space to accommodate feed mechanism and pressure fluid hoses which lead to the beam supported rock drill.

In accordance with another aspect of the present invention there is provided a feed support or feed beam arrangement for a rock drill wherein a plurality of pressure fluid hoses leading to and from the drill proper are trained over a hose guide which is mounted substantially within the envelope of the feed beam with respect to the lateral limits of the feed beam and such hoses are disposed generally within a channel space and are secured to a manifold block mounted on or fixed in relation to the feed beam. The arrangement of the pressure fluid hoses and the hose guide mechanism with respect to the feed beam is such as to substantially protect the hoses from abrasion, and possible damage during operation of the drill.

In accordance with another aspect of the invention there is provided a unique feed beam for a rock drill which is manufactured of formed or rolled steel plate or a metal of similar structural properties and which is fabricated from as few as three (3) generally flat plate components which are formed and secured together in such a way as to provide a channel-type structure with suitable support flanges for a drill slide member and a base member of the beam. The beam configuration is substantially rigid and is formed with flanges and a web portion adapted to be supported by a drill positioning mechanism and the like.

In accordance with yet a further aspect of the present invention there is provided a unique drill advance or feed mechanism which is adapted for operation with the feed beam of the present invention as well as an improved pressure fluid hose guide arrangement but which mechanism in itself is advantageous for use with other feed beam configurations.

Those skilled in the art will recognize the above-described advantages and superior features of the present invention together with other important aspects thereof upon reading the detailed description which follows in conjunction with the drawing.

BRIEF DESCRIPTION OF THE DRAWING

FIG. 1 is a plan view of a rock drill feed support in accordance with the present invention supported on a portable drill positioning unit and aligned to take advantage of the improved lateral profile of the feed support in tunnelling operations;

FIG. 3 is a section view taken generally along the line 3—3 of FIG. 2; and FIG. 4 is a view taken generally along the line 4—4 of FIG. 2.

DESCRIPTION OF A PREFERRED EMBODIMENT

Figure 2:
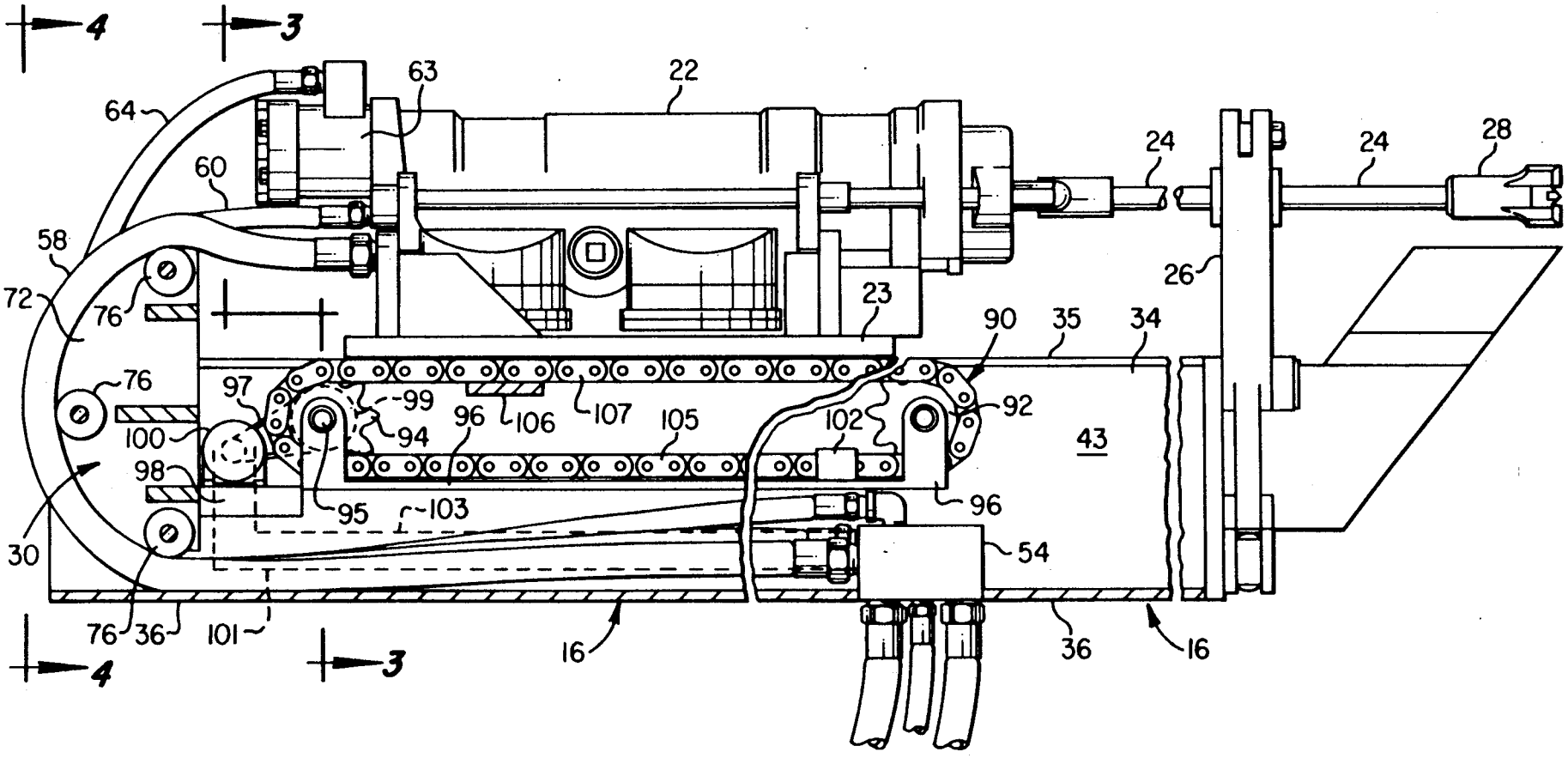
FIG. 2 is a longitudinal central section view of the feed beam and associated feed mechanism in accordance with the present invention.

In the description which follows, like parts are marked throughout the specification and drawing with the same reference numerals, respectively. The drawing figures may show some components in somewhat schematic form in the interest of clarity and conciseness.

The art of pressure fluid operated rock drills and associated feed mechanisms is represented to some extent by U.S. Pat. Nos. 2,365,749 to J. C. Curtis, 2,394,194 to V. J. McCarthy, 3,107,738 to J. D. Osborn and 3,508,619 to M. C. Huffman. These patents are exemplary of the state of the art with respect to pressure fluid operated rock drills and chain-type as well as rack-and-pinion-type drill advance or feed mechanisms. The Curtis patent shows the general arrangement of a fluid operated rock drill supported by an endless chain-type feed mechanism on an elongated feed beam, which beam is mounted on a conventional drill positioner mechanism for pivoting the feed beam about mutually perpendicular axes to provide a selected directional attitude of the drill.

Referring to FIG. 1, an important advantage of the present invention is illustrated by the plan view which shows a portion of a tunnel 10 being drilled in the earth II and having a tunnel face 12 and at least one lateral side wall 14. To advance or form the tunnel, the face 12 is drilled with a selected pattern of blastholes which are loaded with suitable explosive to rubblize the rock for removal. One longstanding problem with conventional rock drill feeds is to provide for aligning the drill for drilling holes close to the intersection of the face 12 with the side wall 14. In accordance with the present invention an improved drill feed support 16 is illustrated and mounted on the distal end of a pivotable boom 18 which, in turn, is supported on a mobile undercarriage 20, commonly known in the art as a drill jumbo. The boom 18 may be positioned in one of a selected number of positions by conventional mechanism, not shown, to align the feed support 16 in different positions for drilling into the tunnel face. The feed support 16 supports for linear advance therealong a pressure fluid operated percussion-type rock drill motor 22, preferably of a type which has a percussion motor operated by hydraulic fluid and a rotation motor operated by hydraulic fluid for simultaneously delivering percussive blows and rotational motion to an elongated drill stem 24. The drill stem 24 is suitably supported at one end of the feed beam 16 by a conventional centralizer 26 and is connected to a percussive bit 28. In accordance with the present invention the feed beam 16 is arranged in combination with a unique hose guide 30 for training a plurality of pressure fluid hoses along the feed beam and which are connected to the rock drill 22 while minimizing the lateral extent or projecting portions of the feed beam.

Referring now to FIGS. 2 and 3, the feed beam 16 is made up of only three elongated metal members 32, 34 and 36, FIG. 3, which are preferably of rolled or formed steel plate. The members 32 and 34 may be identical in construction and arranged to face each other in mirror image fashion as illustrated. The members 32 and 34 are each formed by bending one longitudinal side of the members to form opposed support surfaces or flanges 33 and 35 for supporting a support slide 36 for the rock drill 22. The base of the feed beam 16 is formed by the third member 36 which has opposed longitudinal side portions bent or folded over to form opposed flanges 37 and 39. The members 32 and 34 are secured to the base member 36 by welding at 38, 40, 42 and 44 substantially along the entire length of the feed beam 16. The members 32 and 34 are advantageously inclined outwardly away from each other between the welds 40 and 44 and the respective flanges 33 and 35.

The flanges 37 and 39 are each formed at an angle to provide a generally wedge shape for the lateral sides of the base member 36 for securement to a drill positioning beam, generally designated by the numeral 46. The positioning beam 46 is adapted to be mounted on a conventional drill positioner 48. Removable support plates 50 and 52 contain the beam 16 for sliding movement along the beam 46 by conventional advancing mechanism, if required, not shown. As shown in FIGS. 2 and 3, the configuration of the feed beam 16 provides a substantially clear and unencumbered interior channel space 43 which is advantageous for accommodating a fluid manifold block 54 secured to the member 36 and to which are connected a plurality of pressure fluid hoses 56, 58, 60, 62 and 64, for example. The hoses 56 and 58 provide supply and return hydraulic fluid for a percussion motor of the drill 22 while the hoses 62 and 64 provide supply and return pressure fluid for a drill-stream rotation motor 63. The fifth pressure fluid hose 60 may be provided for drill stem flushing fluid.

As shown in FIG. 2, the manifold block 54 is preferably located generally midway of the overall length of the feed beam 16 and the hoses 56, 58, 60, 62 and 64 are trained along and through the space 43 and around the hose guide, generally designated by the numeral 30, and thence to the drill 22. The hose guide 30, is preferably formed of opposed side plates 72 and 74, FIG. 4, and a series of spaced apart rollers 76, FIG. 2, disposed between the plates 72 and 74 and suitably secured thereto for rotation and for training the hoses 56, 58, 60, 62 and 64 to follow a generally arcuate path in a substantially vertical plane and within the envelope of the feed beam 16 provided by the opposed side members 32 and 34. The hose guide 30 includes suitable means for supporting the hose guide on the flanges 33 and 35, such as laterally projecting support plates 78 and 80 which are connected to suitable retainer members 82 to allow the hose guide to slide along the beam 16 behind the drill 22 but to prevent vertical excursion of the hose guide.

Thanks to the configuration of the feed beam 16 and the hose guide 30, the hoses which conduct pressure fluid to and from the drill 22 are substantially contained within the channel space 43 and are protected from abrasion or possible damage during movement and operation of the jumbo 20. Moreover, the lateral extremities of the feed mechanism supported at the end of the boom 18 are those provided generally by the feed beam 16 and its supporting structure described and illustrated in FIG. 3. The positioning mechanism illustrated in FIG. 3 for supporting and positioning the feed beam 16 has been omitted from FIGS. 2 and 4 in the interest of clarity and conciseness.

Referring further to FIGS. 2 and 3, the present invention also provides a unique feed or drill advance causing mechanism comprising an endless roller-type chain 90 which is trained over spaced apart sprockets 92 and 94 which are each supported on an elongated support member 96. The support member 96 is also connected to the hose guide 30 by a connecting member 98. The sprocket 94 is suitably mounted on a shaft 95 and drivenly connected to a feed motor 100 by an endless belt or chain and shaft mounted sprocket arrangement 97 and 99. The motor 100 may be pressure fluid operated and supplied by pressure fluid from a pair of hydraulic fluid conducting hoses 101 and 103. The feed motor 100 may be suitably mounted on the feed beam 16 between the drill 22 and the hose guide 30 by suitable support structure or, as shown, on the support member 98.

Referring further to FIG. 2, an anchor member 102 is secured to one longitudinal run 105 of the chain 90 and to at least one of the members of the feed beam 16. In like manner an attachment member 106 is provided for connecting the drill slide 23 to the other longitudinal run 107 of the chain 90. In response to operation of the motor 100 to rotate the sprocket 94 the longitudinal run 107 of the chain 90 advances along the feed beam 16 at a rate which is twice the rate of advance of the member 96 and the hose guide 30. Accordingly, the rock drill 22 advances along the feed beam 16 at a rate twice the rate of the hose guide 30 and the arrangement of the hoses trained over the guide and advancing in a linear direction generally parallel to the lengths of the hoses between the manifold block 54 and the hose guide maintains the hoses substantially taut and trained along the feed beam. Thanks to the endless chain 90 supported on the member 96 the drill 22 advances at a rate twice the rate of advance of the member 96 and the hose guide 30.

Those skilled in the art will recognize from the foregoing description that the general construction of the feed beam 16, the arrangement of the pressure fluid hoses 56, 58, 60, 62 and 64, the hose guide 30 and the aforedescribed feed mechanism provides a unique rock drill feed support and associated mechanism. The alignment of the pressure fluid hoses to be trained in an arcuate path about the hose guide 30 and in a generally vertical plane and contained within the channel space 43 prevents interference of the hoses and the hose guide structure with lateral side walls or roof portions of a tunnel. Moreover, the hoses are protected from abrasion and pinching during advancement of the drill and the general layout or plumbing arrangement of the conduits required for supplying pressure fluid to the rock drill 22 is simplified and eliminates many operational problems associated with prior art pressure fluid operated rock drills. Still further, the unique feed or drill advance-causing mechanism allows the use of the layout and arrangement of the hoses and the hose guide 30 and eliminates the conventional hydraulic cylinder-type feed or advance-causing mechanism and the associated problems found from using that type of feed mechanism.

The operation of the feed mechanism of the present invention is believed to be readily understandable to those of ordinary skill in the art from the foregoing description. However, briefly, by energizing the motor 100 the endless chain 90 is advanced as it is driven by the sprocket 94 and around the idler sprocket 92 to advance the beam 96 at ½ the linear rate of the drill 22 along the beam 16 in both directions. By locating the manifold block 54 approximately midway between the opposed longitudinal ends of the beam 16 the drill 22 may be fully advanced to the forward end of the beam at which the centralizer 26 is mounted while the hose guide 30 is required to advance to approximately the position of the manifold 54.

The foregoing feed beam 16 and the associated feed mechanism represented by the chain 90, the sprockets 92 and 94 and the support beam 96 together with the motor 100 may be constructed using conventional engineering practices and materials known in the art of rock drill feed mechanisms and hydraulic components. Although a preferred embodiment of the present invention has been described in detail herein those skilled in the art will recognize that various substitutions and modifications may be made to the embodiment described without departing from the scope and spirit of the invention as recited in the appended claims.

What is claimed is:

1. A feed support for a pressure fluid operated drill, said drill having a drill motor operated by pressure fluid to activate an elongated drill stem and bit, said feed support comprising:

an elongated feed beam comprising a base member and opposed side members delimiting a lateral envelope of said feed beam and defining a substantially open channel space over a predetermined length of said beam, said base member being formed of metal plate having means forming opposed flanges, said side members each being formed of metal plate and each including lower longitudinal side edges generally vertically spaced from said flanges of said base member, respectively, and said base member and said opposed side members are secured to each other by welding along each of said longitudinal side edges of said side members and edges of said flanges of said base member, respectively;

a plurality of pressure fluid hoses extending along said channel space from a point between opposite ends of said beam;

a hose guide for training said hoses to reverse their direction in a generally vertical plane from said point to said drill motor; and feed mechanism connected to said drill motor for advancing said drill motor along said feed beam and wherein said hoses are contained substantially within the lateral envelope of said feed beam.

2. The feed support set forth in claim 1 wherein:

said means forming said flanges of said base member comprise opposed longitudinal portions of said base member which are folded over to form said flanges of said base member, and said opposed side members each include elongated metal plates which are folded over along at least one edge to form opposed support flanges for said drill motor.

3. The feed support set forth in claim 1 wherein:

said side members are inclined outwardly away from each other from said base member toward said support flanges for said drill motor.

4. A feed support for a pressure fluid operated drill, said drill having a drill motor operated by pressure fluid to activate an elongated drill stem and bit, said feed support comprising:

an elongated feed beam defining a substantially open channel space over a predetermined length of said beam;

said feed beam comprising a base member formed of metal plate having opposed longitudinal edges which are folded over to form opposed flanges, and opposed side members each including elongated metal plates having lower longitudinal side edges generally vertically spaced from said flanges and, respectively, upper longitudinal side edges, said upper longitudinal side edges being folded over to form opposed support flanges for said drill motor, said base member and said opposed side members are secured to each other by welding along said lower longitudinal side edges of said side members and edges of said flanges of said base member, respectively; and feed mechanism connected to said drill motor for advancing said drill motor along said feed beam and contained substantially within said channel space.

5. The feed support set forth in claim 4 wherein:

said side members are inclined outwardly away from each other from said base member toward said support flanges for said drill motor.

6. A feed support for a pressure fluid operated drill, said drill having a drill motor operated by pressure fluid to activate an elongated drill stem and bit, said feed support comprising:

an elongated feed beam comprising a base member and opposed side members delimiting a lateral envelope of said feed beam and defining a substantially open channel space over a predetermined length of sad feed beam, said base member being formed of metal plate having opposed longitudinal edges which are folded over to form opposed flanges, said opposed side members each including elongated metal plates which are folded over along at least one edge to form opposed support flanges for said drill motor, said base member and said opposed side members are secured to each other by welding along at least one of longitudinal side edges of said side members and edges of said flanges of said base member, respectively, and said side members are inclined outwardly away from each other from said base member toward said support flanges for said drill motor;

a plurality of pressure fluid hoses extending along said channel space from a point between opposite ends of said feed beam;

a hose guide for training said hoses to reverse their direction in a generally vertical plane from said point to said drill motor, said hose guide being supported by and between said support flanges for movement through said channel space; and feed mechanism connected to said drill motor for advancing said drill motor along said feed beam and wherein said hoses are contained substantially within said lateral envelope of said feed beam.

7. The feed support set forth in claim 6 wherein:

said hose guide comprises a pair of opposed plate members and a plurality of hose support rollers disposed between said plate members and arranged in a substantially arcuate path for training said hoses to reverse their direction of lay between said point and said drill motor.

8. The feed support set forth in claim 7 wherein:

said feed mechanism comprises a support member, an endless flexible member supported for movement on said support member, spaced apart sprocket means for supporting said endless flexible member;

means for connecting said endless flexible member to said feed beam at a predetermined point;

means for connecting said drill motor to said endless flexible member at a predetermined point; and motor means drivably connected to said endless flexible member for advancing said drill motor along said feed beam. .

9. The feed support set forth in claim 8 wherein:

said hose guide is connected to said support member for advancement along said feed beam with said support member at a linear rate one-half the advancing rate of said drill motor.

10. The feed support set forth in claim 9 wherien:

said endless flexible member comprises a chain secured to said drill motor along a first longitudinal run between said spaced apart sprocket means and said chain is secured by said member to said feed beam along the other longitudinal run of said chain between said sprocket means.

11. A feed support for a pressure fluid operated drill, said drill having a drill motor operated by pressure fluid to activate an elongated drill stem and bit, said feed support comprising:

an elongated feed beam defining a substantially open channel space over a predetermined length of said beam;

said feed beam comprising a base member formed of metal plate having opposed longitudinal edges which are folded over to form opposed flanges, and opposed side members each including elongated metal plates which are folded over along at least one edge to form opposed support flanges for said drill motor;

a hose guide supported by and between said support flanges for movement through said channel space, said hose guide comprising a pair of opposed plate members and a plurality of hose support rollers disposed between said plate members and arranged in a substantially arcuate path for training a plurality of hoses to reverse their direction of lay between a predetermined point on said feed beam and said drill motor; and feed mechanism connected to said drill motor for advancing said drill motor along said feed beam and contained substantially within said channel space.

12. A feed support for a pressure fluid operated drill, said drill having a drill motor operated by pressure fluid to activate an elongated drill stem and bit, said feed support comprising:

an elongated feed beam having a substantially open channel space over a predetermined length of said feed beam;

feed mechanism connected to said drill motor for advancing said drill motor along said feed beam, said feed mechanism comprising a support member, an endless flexible chain supported for movement on said support member and spaced apart sprocket means for supporting said chain;

means for connecting said drill motor to said chain at a predetermined point along a first longitudinal run of said chain between said sprocket means;

means for connecting said chain to said feed beam at a predetermined point along the other longitudinal run of said chain between said sprocket means; and motor means drivably connected to said chain for advancing said drill motor along said feed beam.

13. The feed support set forth in claim 12 including:

a hose guide connected to said support member for advancement along said feed beam with said support member at a linear rate one-half the advancing rate of said drill motor.

* * * * *